US010759585B2

(12) United States Patent
Bazbaz et al.

(10) Patent No.: US 10,759,585 B2
(45) Date of Patent: Sep. 1, 2020

(54) WOVEN PLASTIC BAGS WITH FEATURES THAT REDUCE LEAKAGE, BREAKAGE AND INFESTATIONS

(71) Applicant: Polytex Fibers Corporation, Houston, TX (US)

(72) Inventors: Jacobo Bazbaz, Bellaire, TX (US); Alberto Zaroli, Katy, TX (US)

(73) Assignee: Polytex Fibers Corporation, Houston, TX (US)

( * ) Notice: Subject to any disclaimer, the term of this patent is extended or adjusted under 35 U.S.C. 154(b) by 129 days.

(21) Appl. No.: 15/440,970

(22) Filed: Feb. 23, 2017

(65) Prior Publication Data

US 2017/0247160 A1 Aug. 31, 2017

Related U.S. Application Data

(63) Continuation of application No. 14/678,641, filed on Apr. 3, 2015, now Pat. No. 9,669,983.
(Continued)

(51) Int. Cl.

| | |
|---|---|
| ***B65D 30/08*** | (2006.01) |
| ***B65D 77/38*** | (2006.01) |
| ***B65D 30/20*** | (2006.01) |
| ***B65D 33/02*** | (2006.01) |
| ***B65D 33/00*** | (2006.01) |
| ***B65D 33/16*** | (2006.01) |

(52) U.S. Cl.
CPC ..... *B65D 77/38* (2013.01); *B65D 31/02* (2013.01); *B65D 31/10* (2013.01); *B65D 33/00* (2013.01); *B65D 33/02* (2013.01); *B65D 33/16* (2013.01)

(58) Field of Classification Search
CPC ..... B65D 33/00; B65D 33/02; B65D 33/16; B65D 77/38; B65D 31/02; B65D 31/10
See application file for complete search history.

(56) References Cited

U.S. PATENT DOCUMENTS

| | | | |
|---|---|---|---|
| 258,925 | A | 6/1882 | Holmes |
| 2,634,896 | A | 4/1953 | Graveno |

(Continued)

FOREIGN PATENT DOCUMENTS

| | | |
|---|---|---|
| CA | 2269652 | 4/1999 |
| EP | 1035028 | 9/2000 |

(Continued)

OTHER PUBLICATIONS

International Search Report and Written Opinion of the International Searching Authority, International Patent Application No. PCT/US2012/032520, dated Jul. 16, 2012.

(Continued)

*Primary Examiner* — Derek J Battisti
(74) *Attorney, Agent, or Firm* — Vinson & Elkins L.L.P.

(57) ABSTRACT

A woven laminated plastic bag having features that further prevent leakage of contents out of the bag, or infestation of organisms into the contents of the bag is provided. In various aspects the bag can be fabricated from woven polypropylene and/or polyethylene layer which can be laminated with a film layer, can form a pinch bottom bag, and can have one or both sides include graphics and/or printing. The bag can also provide a top end and/or a bottom end either or both of which provide a discrete area which may contain discrete graphics and/or printing.

27 Claims, 6 Drawing Sheets

Related U.S. Application Data

(60) Provisional application No. 61/975,689, filed on Apr. 4, 2014.

(56) References Cited

U.S. PATENT DOCUMENTS 2,991,000 A 7/1961 Spees
3,058,647 A 10/1962 Reiselt
3,203,620 A 8/1965 Becker
3,285,498 A 11/1966 Becker
3,508,701 A * 4/1970 Saito ..... B65D 31/10 383/109
3,565,328 A 2/1971 Hudson
3,648,922 A 3/1972 Gebo
3,650,460 A 3/1972 Lokey
3,685,720 A 8/1972 Brady
3,687,356 A 8/1972 Goodrich
3,990,626 A 11/1976 Goodrich
4,008,850 A 2/1977 Goodrich
4,142,667 A 3/1979 Runo
4,292,332 A 9/1981 McHam
4,373,979 A 2/1983 Planeta
4,441,613 A 4/1984 Ham
4,460,091 A 7/1984 Ham
4,480,752 A 11/1984 Jacobs
4,512,479 A 4/1985 Ham
4,515,273 A 5/1985 Jacobson
4,557,385 A 12/1985 Robinson
4,567,987 A 2/1986 Lepisto
4,610,651 A 9/1986 Jacobson
4,768,654 A 9/1988 Jacobs
4,785,940 A 11/1988 Wilson
4,811,849 A 3/1989 Rausing
4,836,378 A 6/1989 Lephardt
4,955,981 A 9/1990 Provost
5,048,692 A 9/1991 Handler
5,188,235 A 2/1993 Pierce et al.
5,217,307 A 6/1993 McClintock
5,558,438 A 9/1996 Warr
5,655,843 A 8/1997 Conrad
5,830,543 A 11/1998 Miyake
5,855,435 A 1/1999 Chiesa
5,902,047 A 5/1999 Yeager
5,908,246 A 6/1999 Anmura
5,938,013 A 8/1999 Palumbo
5,979,655 A 11/1999 Tseng et al.
6,013,018 A 1/2000 Bannister
6,047,883 A 4/2000 Calvert
6,074,095 A 6/2000 Bannister
6,126,316 A 10/2000 Bannister
6,126,317 A 10/2000 Anderson
6,224,262 B1 5/2001 Hogan
6,241,390 B1 6/2001 Schneck
6,315,448 B1 11/2001 Thrall
6,328,472 B1 12/2001 Laurence
6,334,711 B1 1/2002 Risgalla
6,367,976 B1 4/2002 Bannister
6,478,465 B1 11/2002 Thrall
6,609,999 B2 8/2003 Albright
6,635,711 B1 10/2003 Miskovic et al.
6,698,928 B2 3/2004 Miller
6,800,051 B2 10/2004 Koehn
6,966,134 B2 11/2005 Ngan
6,979,482 B2 12/2005 Hartzell
7,090,904 B2 4/2006 Hartzell
7,165,887 B2 1/2007 Strand et al.
7,237,953 B2 7/2007 Healy
7,311,442 B1 12/2007 Moravek
7,523,825 B2 4/2009 Velazquez
7,563,027 B2 7/2009 Allen
7,722,255 B2 5/2010 Chiesa
7,731,425 B2 6/2010 Lin et al.
7,753,588 B2 7/2010 Bazbaz
8,173,233 B2 5/2012 Rogers
8,227,062 B2 7/2012 Nowak
8,240,915 B2 8/2012 Sargin
8,241,193 B2 8/2012 Jansen
8,241,194 B2 8/2012 Skopek
8,297,840 B2 10/2012 Jansen
8,443,578 B2 5/2013 Sargin
8,475,046 B2 7/2013 Jansen
8,535,209 B2 9/2013 Sargin
8,540,427 B2 9/2013 Steele
9,073,281 B2 7/2015 Sargin
9,233,502 B2 1/2016 Sargin
2003/0040411 A1 2/2003 Albright
2003/0139516 A1 7/2003 Quinn
2003/0152299 A1 8/2003 Culbertson
2003/0228077 A1 12/2003 Laske
2004/0091648 A1 5/2004 Hartzell
2005/0087542 A1 4/2005 Bazbaz
2005/0226542 A1 10/2005 Kendall
2006/0045392 A1 3/2006 Bannister
2006/0072856 A1 4/2006 Su
2006/0285777 A1 12/2006 Howell
2006/0285781 A1 12/2006 Zoss
2007/0047852 A1 3/2007 Sharp
2007/0047853 A1 3/2007 Sharp
2007/0104905 A1* 5/2007 Floyd, Jr. ..... B60R 21/235 428/36.1
2007/0140600 A1 6/2007 Nowak
2007/0292053 A1* 12/2007 Lin ..... B65D 31/02 383/78
2008/0047228 A1 2/2008 Anzini
2008/0187695 A1 8/2008 Nowak
2008/0292223 A1* 11/2008 Bannister ..... B32B 1/08 383/114
2009/0080813 A1 3/2009 Rasmussen
2009/0136161 A1 5/2009 Hickey
2009/0148081 A1 6/2009 Rogers
2009/0159192 A1 6/2009 Bannister
2009/0263048 A1 10/2009 Iannelli
2009/0324143 A1 12/2009 Sharp
2010/0029455 A1 2/2010 Spopek et al.
2010/0154362 A1 6/2010 Jansen
2010/0158417 A1* 6/2010 Sharp ..... B32B 27/10 383/94
2010/0158418 A1 6/2010 Jansen
2010/0189380 A1 7/2010 Sargin
2010/0209026 A1 8/2010 Koemgkramer
2010/0266223 A1* 10/2010 Lin ..... B65D 31/02 383/78
2010/0270309 A1 10/2010 Files
2010/0278454 A1 11/2010 Huffer
2010/0293897 A1 11/2010 Jansen
2011/0002560 A1 1/2011 Robles
2011/0019944 A1* 1/2011 Sargin ..... B65D 31/10 383/120
2011/0038569 A1 2/2011 Huffer
2011/0082019 A1* 4/2011 Bannister ..... A45C 3/001 493/269
2011/0103721 A1 5/2011 Sargin
2011/0147383 A1 6/2011 Soudais
2011/0255807 A1 10/2011 Shapiro et al.
2011/0263400 A1* 10/2011 Sargin ..... B65D 33/22 493/227
2012/0314979 A1 12/2012 Heininga
2012/0321229 A1 12/2012 Surdziel
2013/0016926 A1 1/2013 Koehn
2013/0047555 A1 2/2013 Jansen
2013/0206631 A1 8/2013 Bazbaz
2013/0209002 A1 8/2013 Bazbaz
2013/0330028 A1* 12/2013 Bannister ..... B65D 31/00 383/123
2014/0090339 A1 4/2014 Sargin
2015/0183194 A1 7/2015 Lehmann

FOREIGN PATENT DOCUMENTS

EP 1468931 10/2004
EP 1780136 5/2007
EP 2263949 12/2010
EP 2599617 6/2013

(56) References Cited

FOREIGN PATENT DOCUMENTS

| | | | | |
|---|---|---|---|---|
| WO | 9961344 | | 12/1999 | |
| WO | 2003040411 | | 5/2003 | |
| WO | 2005030600 | | 4/2005 | |
| WO | 2008146142 | | 12/2008 | |
| WO | 2008157681 | | 12/2008 | |
| WO | 2009016644 | | 2/2009 | |
| WO | 2009082712 | | 7/2009 | |
| WO | WO2009082712 | * | 7/2009 | ..... B65D 30/06 |
| WO | 2012040097 | | 3/2012 | |
| WO | 2012141981 | | 10/2012 | |
| WO | 2013123015 | | 8/2013 | |
| WO | 2015103103 | | 7/2015 | |

OTHER PUBLICATIONS

International Search Report and Written Opinion of the International Searching Authority, International Patent Application No. PCTA/US2013/025891, dated Apr. 29, 2013.

International Search Report and Written Opinion of the International Searching Authority, International Patent Application No. PCTA/US2013/064555, dated Jan. 3, 2014.

* cited by examiner

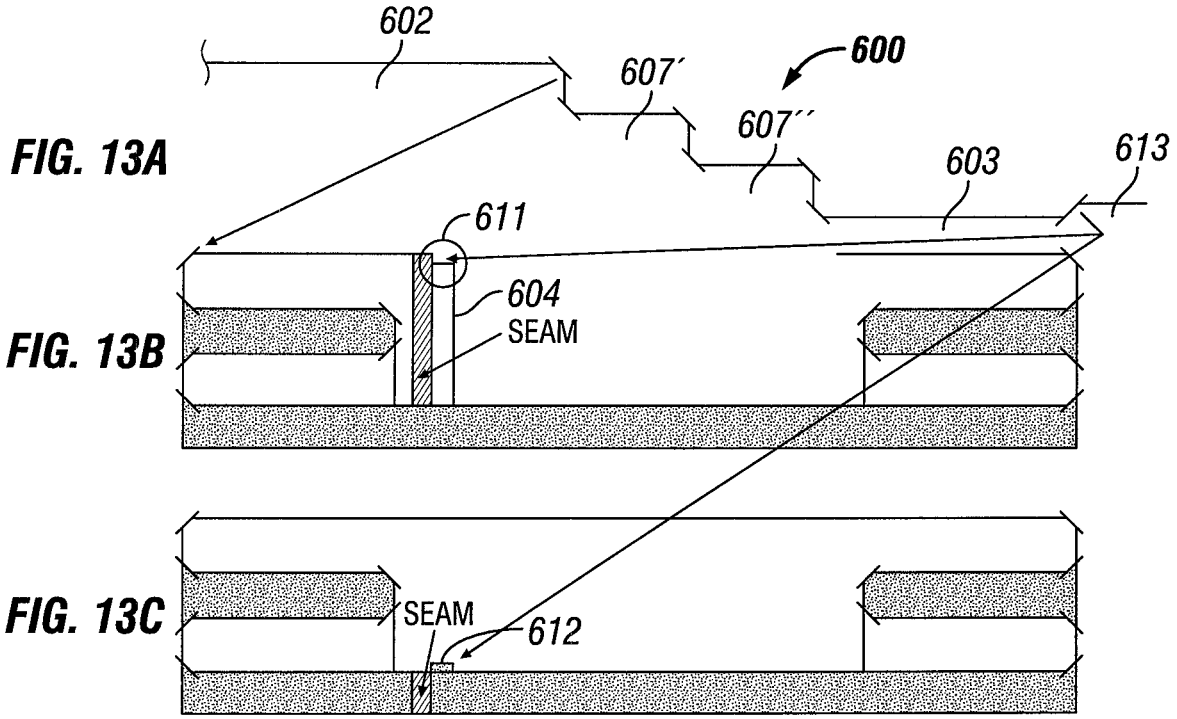
FIG. 13A
FIG. 13B
FIG. 13C
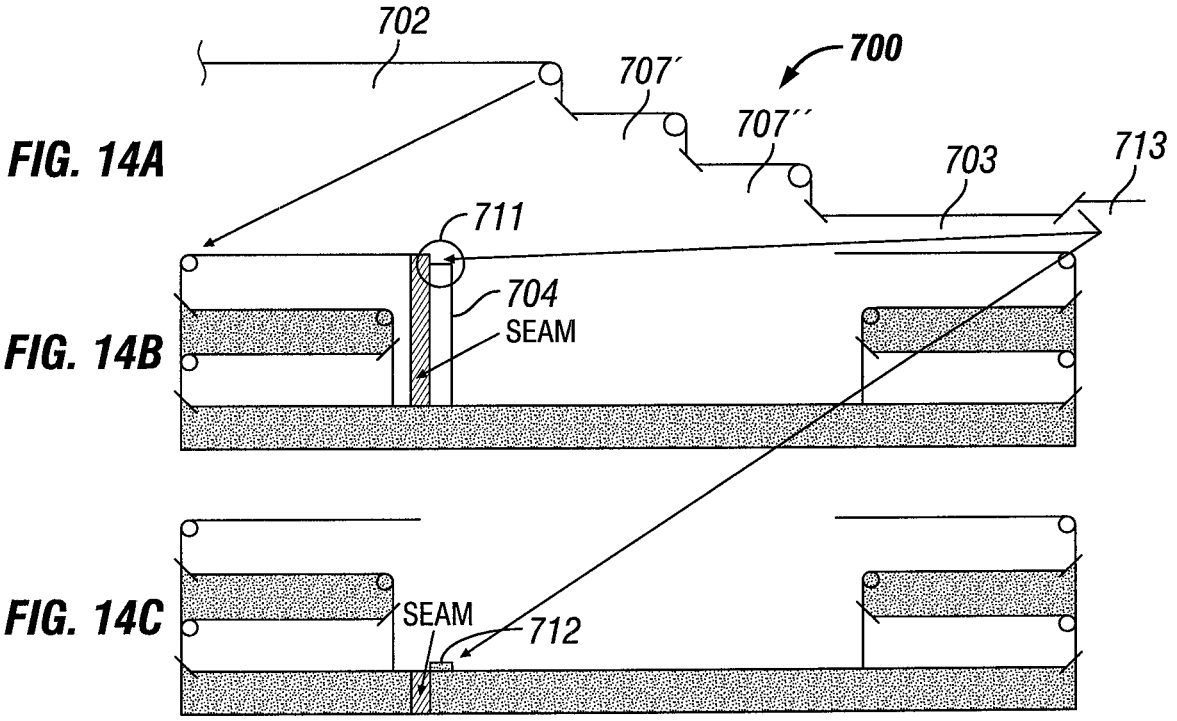
FIG. 14A
FIG. 14B
FIG. 14C

WOVEN PLASTIC BAGS WITH FEATURES THAT REDUCE LEAKAGE, BREAKAGE AND INFESTATIONS

CROSS-REFERENCE TO RELATED APPLICATIONS

This application is a continuation of copending U.S. patent application Ser. No. 14/678,641, filed Apr. 3, 2015, which claims benefit of priority of U.S. Provisional Application Ser. No. 61/975,689, filed Apr. 4, 2014, both of which are incorporated herein in their entirety for all purposes.

FIELD OF THE INVENTION

The present disclosure generally relates to woven plastic bags, and more particularly to woven plastic bags with features that reduce the potential for leakage, breakage and infestation.

BACKGROUND OF THE INVENTION

Conventional plastic bags of a wide variety of size and shape are used in various situations. Bulk materials, such as flour, sugar, rice, seed, animal feed, chemicals, powdered materials or the like, for example, typically have been packaged in woven plastic bags in the past. Pet food, bird seed and other products sold in retail stores typically have not been packaged in conventional woven plastic bags. Among other reasons for this, woven plastic bags were considered too rudimentary to be printed with high end graphics suitable for consumer type of packaging. In addition, the high speed requirements in the filling and packaging operations limited the use of the woven bags in these applications.

Laminated woven sacks (LWS) were developed using a woven polypropylene structure laminated to a bi-oriented polypropylene film (BOPP) that can be reverse printed with high end graphics suitable for consumer type of packaging. The LWS provides a stronger, more attractive bag than the more conventional multiwall bags used for that purpose over the last 20 years. Due to their tough strong structure, conventional LWS bags are typically sewn shut on both ends. These LWS recently met with success and have been successfully substituted for the conventional multiwall paper bags used in the pet food industry for many years.

One major drawback of the sewn LWS has been the closing of the bags at high speed filling lines, such as those for filling such bags with pet food. Experience has shown that sewing production lines are typically slower than the filling of the multiwall pinch bottom bags. Additionally, the sewn bags do not provide an aesthetically pleasing and useful clean display on the ends of the bags, thus making it difficult for consumers to identify or find a desired brand quickly when the bags are displayed on the shelves at the point of sale, such as when they are stacked on top of one another. In addition, the sewn ends required puncturing the plastic bags and thus result in a bag that is not sealed, leading to somewhat reduced shelf-life and possible infestation of the contents of the bag.

Woven plastic bags have been used and are conventional for certain applications. An example of a conventional woven plastic bag is provided in U.S. Pat. No. 4,373,979 ("the '979 patent"), issued on Feb. 15, 1983. The '979 patent describes the use of woven strips of highly longitudinally-oriented, high-density polyethylene or polypropylene in a bag construction in which the bag is formed from a seamed tube made of the woven plastic material. The seamed tube has gussets on either side and, when a portion is cut from the rest of the tube, a bag having two open, unsealed ends is provided. The '979 patent describes the use of ultrasonic spot welds to seal portions of a bag made of such woven plastic strips, as opposed to sewing the seams of a bag or using a hot melt adhesive to seal the gusset forming pleat. The '979 patent is hereby incorporated by reference herein. The '979 patent purports to be an improvement for sealing a plastic bag. As noted in the '979 patent, sewing one end tends to take longer, thus adding time to the manufacturing process. In addition, the sewn ends in a conventional bag tend to be a weak portion of the bag, and a likely location for rips, tearing, and subsequent loss of contents during storing, shipping and handling. In addition, such bags may not provide sufficient protection from infestation from vermin and/or insects.

Another example of plastic bags is disclosed in U.S. Patent Application Publication Number US 2010/0029455 A1 ("the '455 publication"), published on Feb. 4, 2010, which describes production of web sections from a flexible web material that is provided with tear-off lines produced by laser beam processing at the distance of the length of the web sections to be formed. The tear-off lines weaken the flexible web material, but do not result in complete separation of the web sections from the web material, which occurs upon tearing the flexible web material. The '455 publication is incorporated by reference herein.

More recently, some types of plastic bags have provided improvements in sealing the ends of the bags. For example, in U.S. Pat. No. 6,800,051 B2 ("the '051 patent"), issued on Oct. 5, 2004, a process for sealing side fold sacks made of plastic film is described. According to the '051 patent, a web of plastic tubular film is cut to provide a staggered detachment along a perforation so that one wall (e.g., the front wall) projects beyond the opposing wall (e.g., the back wall). The projecting portion of the first wall is then folded over and sealed to the opposing wall by means of a plastic adhesive such as a polyurethane adhesive or hot melt. The '051 patent is hereby incorporated by reference herein. However, such bags involve plastic films, not woven plastic materials, and therefore are unable to handle the weight loads of conventional bulk bags made of paper and other materials. Such bags are useful for only certain lightweight contents, such as bread.

There are a variety of conventional ways of providing for reusable openings in bags. For example, U.S. Pat. No. 6,478,465 B1 ("the '465 patent"), issued Nov. 12, 2002, describes a peelable opening in a multiwall, pinched bottom open mouth bag construction. The '465 patent also describes the use of an adhesive layer that can be used so that the bag opening is reclosable. The '465 patent is hereby incorporated by reference herein.

In other types of conventional plastic bags, such as those used in retail and grocery stores, the use of weakened portion provided by one or more perforations in the plastic bag wall is known. A number of approaches have been taken in connection with such bags, including those shown in U.S. Pat. No. 5,188,235 (the '235 patent), issued Feb. 23, 1993, as well as in U.S. Published Patent Application No. 2005/0087542 A1 (the '542 application), published Apr. 28, 2005, U.S. Pat. No. 5,979,655 (the '655 patent), issued Nov. 9, 1999, and U.S. Published Patent Application No. 2006/0072856 (the '856 application), issued Apr. 6, 2006. However, none of these bags are woven bags, let alone bags with multiple layers. The '235 patent, the '655 patent, the '542 application, and the '856 application are hereby incorporated by reference.

Newly developed pinch laminated woven sacks overcome these drawbacks in the filling and closing operations while allowing an attractive graphic display of the bags' ends at the retail outlet and also providing a strong, durable bag which remains sealed. However, such bags still remain susceptible to leakage, breakage and infestation at both ends of the seam and in the area along the top and bottom of the gussets. There is a need for such a pinch bottom laminated woven sack that includes one or more feature(s) that prevent leakage, breakage and/or infestation at both ends of the seam and in the area along the top and bottom of the gussets. Moreover, the bag needs to be strong enough to avoid leakage, breakage or infestation, which can begin with a small opening or crack that then gets larger over time, such as with additional forces or movement of the bag. At the same time, however, it is desirable to avoid "solutions' that require additional plastic material, additional adhesive material, such as for extra strength, or that slow the speed of manufacture. Such "solutions" increase the cost of the bag.

SUMMARY OF THE INVENTION

The present disclosure provides woven plastic bags comprising one or more features that prevent leakage and/or infestation at both ends of the seam and in the area along the top and bottom of the gussets.

The present disclosure provides bags that have certain sections that are separated by an angled portion or edge, a curved portion or edge, or a combination thereof, and/or bags that comprise a cut-out and corresponding tab at opposing ends of the bag proximal to the portions of the back wall that form the seam. In one embodiment, the bag comprising a front wall, a back wall having a first portion and a second portion, a first side wall having a first portion proximal to the first portion of the back wall and a second portion proximal to the front wall, a second side wall having a first portion proximal to the second portion of the back wall and a second portion proximal to the front wall, an interior surface, an exterior surface, a top end, a bottom end, a first layer and a second layer, each of the front wall, back wall, first side wall and second side wall having an interior surface, an exterior surface, a top end and a bottom end, wherein the first layer comprises a woven polymer and the second layer comprises a polymer or paper attached to the first layer, wherein the back wall projects further than the top end of the first portion of the first side wall and the top end of the first portion of the second side wall, the top end of the first portion of the first side wall and the top end of the first portion of the second side wall projects further than the top end of the second portion of the first side wall and the top end of the second portion of the second side wall, and the top end of the second portion of the first side wall and the top end of the second portion of the second side wall projects further than the top end of the front wall, wherein at least a portion of the bottom end of the front wall projects further than the bottom end of the second portion of the first side wall and the bottom end of the second portion of the second side wall, the bottom end of the second portion of the first side wall and the bottom end of the second portion of the second side wall project further than the bottom end of the first portion of the first side wall and the bottom end of the first portion of the second side wall, and the bottom end of the first portion of the first side wall and the bottom end of the first portion of the second side wall project further than the bottom end of the back wall, and wherein the top end of the first portion of the back wall and the top end of the first portion of the first side wall, the top end of the first portion of the first side wall and the top end of the second portion of the first side wall, the top end of the second portion of the first side wall and the top end of the front wall, the top end of the front wall and the top end of the second portion of the second side wall, the top end of the second portion of the second side wall and the top end of the first portion of the second side wall, the top portion of the first portion of the second side wall and the top portion of the second portion of the back wall, the bottom end of the first portion of the back wall and the bottom end of the first section of the first side wall, the bottom end of the first portion of the first side wall and the bottom end of the second portion of the first side wall, the bottom end of the second portion of the first side wall and the bottom end of the front wall, the bottom end of the front wall and the bottom end of the second portion of the second side wall, the bottom end of the second portion of the second side wall and the bottom end of the first portion of the second side wall, and the bottom end of the first portion of the second side wall and the bottom end of the second portion of the back wall are separated by an angled edge or portion, a curved edge or portion, or a combination thereof, and wherein the top end of the second portion of the back wall comprises a cut-out and the bottom end of the second portion of the back wall comprises a corresponding tab.

In certain embodiments the angled edge or portion is between about 15° and about 75°, or between about 30° and about 60°, with respect to the top end of the front wall. In other embodiments the angled edge or portion is about 10°, 15°, 20°, 25°, 30°, 35°, 40°, 45°, 50°, 55°, 60°, 65°, 70°, 75°, or 80° with respect to the top end of the front wall. In further embodiments the curved edge or portion is a radial edge or portion, an elliptical edge or portion, a parabolic edge or portion, or a hyperbolic edge or portion. In additional embodiments the bag comprises an easy open or easy access feature, which in certain embodiments can comprise a weakened area.

The present disclosure additionally provides a bag comprising a front wall, a back wall, a first side wall, a second side wall, an interior surface, an exterior surface, a top end, a bottom end, a first layer and a second layer, each of the front wall, back wall, first side wall and second side wall having an interior surface, an exterior surface, a top end and a bottom end, wherein the first layer comprises a woven polymer and the second layer comprises a polymer or paper attached to the first layer, and wherein the bag comprises a weakened area located on the front wall of the bag, the first side wall of the bag and the back wall of the bag proximal the top end of the bag. In some embodiments the first layer comprises polypropylene, high density polyethylene, low density polyethylene, polyester, or any combination thereof. In other embodiments the second layer comprises a film. In still other embodiments the second layer comprises polypropylene, polyethylene, polyethylene terephthalate, polyamide, or any combination thereof or paper. In yet other embodiments the second layer comprises oriented polypropylene, biaxially-oriented polypropylene, oriented polyethylene, biaxially-oriented polyethylene, oriented polyethylene terephthalate, biaxially-oriented polyethylene terephthalate, oriented polyamide, biaxially-oriented polyamide, coated paper or any combination thereof. In further embodiments at least a portion of the second layer comprises a printed area thereon. In still further embodiments the first layer and second layer are laminated together. In yet further embodiments the first layer and second layer are laminated together using adhesive lamination or extrusion lamination.

In additional embodiments the weakened area comprises a plurality of perforations that penetrate through at least a portion of the front wall of the bag, the first side wall of the bag and the back wall of the bag. In some embodiments the plurality of perforations forms a line. In various embodiments the plurality of perforations forms a line that extends from any position on the front wall of the bag, for example about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 97%, about 98% or about 99% of a distance across the front wall of the bag, across the first side wall of the bag, to any position on the back wall of the bag, for example about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, about 97%, about 98% or about 99% of a distance across the back wall of the bag. In other embodiments the plurality of perforations forms a wave pattern. In further embodiments the plurality of perforations forms a zigzag pattern. In still further embodiments the weakened area comprises a deformation in least a portion of the front wall of the bag, the first side wall of the bag and the back wall of the bag. In yet further embodiments the weakened area further comprises a scoring mark. In certain embodiments each of the first layer and the second layer of the bag comprise a weakened portion. In still other embodiments the back wall of the bag comprises a seam.

In certain embodiments the top end of the back wall projects further than the top end of a portion of the first side wall proximal to the back wall and the top end of a portion of the second side wall proximal to the back wall, the top end of a portion of the first side wall proximal to the back wall and the top end of a portion of the second side wall proximal to the back wall projects further than the top end of a portion of the first side wall proximal to the front wall and the top end of a portion of the second side wall proximal to the front wall, and the top end of a portion of the first side wall proximal to the front wall and the top end of a portion of the second side wall proximal to the front wall projects further than the top end of the front wall. In other embodiments at least a portion of the bottom end of the front wall projects further than the bottom end of a portion of the first side wall proximal to the front wall and the bottom end of a portion of the second side wall proximal to the front wall, the bottom end of a portion of the first side wall proximal to the front wall and the bottom end of a portion of the second side wall proximal to the front wall project further than the bottom end of a portion of the first side wall proximal to the back wall and the bottom end of a portion of the second side wall proximal to the back wall, and the bottom end of a portion of the first side wall proximal to the back wall and the bottom end of a portion of the second side wall proximal to the back wall project further than the bottom end of the rear wall. In further embodiments the top end of a portion of the first side wall proximal to the back wall and the top end of a portion of the first side wall proximal to the front wall are separated by an angled cut, and the bottom end of a portion of the first side wall proximal to the back wall and the bottom end of a portion of the first side wall proximal to the front wall are separated by an angled cut.

In additional embodiments the portion of the bottom end of the front wall that projects further than the bottom end of the first side wall and the bottom end of the second side wall, and the portion of the bottom end of the first side wall and the bottom end of the second side wall that project further than the bottom end of the rear wall are sealed to the outer surface of the bottom end of the rear wall. In certain embodiments the bottom end of the bag is sealed using an adhesive sealing, heat sealing, adhesive lamination, extrusion lamination, stitching, ultrasonic energy, pressure, tape, or any combination thereof. In some embodiments the bottom end of the bag is sealed using adhesive-to-adhesive sealing or adhesive-to-bag sealing. In further embodiments the bottom end of the front wall, the bottom end of the first side wall, the bottom end of the rear wall and the bottom end of the second side wall each project the same distance. In still further embodiments at least a portion of a single fold of the bottom end of the bag is sealed to the outer surface of the front wall or the outer surface of the rear wall of the bag. In yet further embodiments at least a portion of a double fold of the bottom end of the bag is sealed to the outer surface of the front wall or the outer surface of the rear wall of the bag.

In other embodiments the top end of the front wall, the top end of the first side wall, the top end of the rear wall and the top end of the second side wall each project the same distance. In certain embodiments at least a portion of the bottom end of the front wall projects further than the bottom end of a portion of the first side wall proximal to the front wall and the bottom end of a portion of the second side wall proximal to the front wall, the bottom end of a portion of the first side wall proximal to the front wall and the bottom end of a portion of the second side wall proximal to the front wall project further than the bottom end of a portion of the first side wall proximal to the back wall and the bottom end of a portion of the second side wall proximal to the back wall, and the bottom end of a portion of the first side wall proximal to the back wall and the bottom end of a portion of the second side wall proximal to the back wall project further than the bottom end of the rear wall. In still other embodiments the portion of the bottom end of the front wall that projects further than the bottom end of the first side wall and the bottom end of the second side wall, and the portion of the bottom end of the first side wall and the bottom end of the second side wall that project further than the bottom end of the rear wall are sealed to the outer surface of the bottom end of the rear wall. In additional embodiments the bottom end of the front wall, the bottom end of the first side wall, the bottom end of the rear wall and the bottom end of the second side wall each project the same distance. In certain embodiments the top end and the bottom end of the bag are sealed, and wherein the bag comprises at least ten pounds by weight of a filling material.

In some embodiments the bag further comprises a third layer comprising a polymer between the first layer and the second layer. In certain embodiments the third layer comprises a woven polymer. In other embodiments the third layer comprises polypropylene, high density polyethylene, low density polyethylene, polyester, or any combination thereof. In further embodiments the third layer comprises a polymeric film. In additional embodiments the third layer comprises polypropylene, polyethylene, polyethylene terephthalate, polyamide, or any combination thereof. In still other embodiments each of the first layer, the second layer and the third layer of the bag comprise a weakened portion.

In further embodiments the bag comprises printing on the front wall, the first side wall, the back wall, the second side wall, the first end, the second end, or any combination thereof. In still further embodiments at least portions of the exterior surfaces of each of the front wall and the back wall comprise a plurality of discrete areas further comprising printing thereon. In yet further embodiments a portion of the front wall and a portion of the back wall combine to form a discrete portion of the bag located at or near either the top end or the bottom end, wherein the discrete portion of the bag comprises printing thereon.

These and other objects of the invention will be apparent to those skilled in the art from the following detailed description.

BRIEF DESCRIPTION OF THE DRAWINGS

The following drawings are included to further demonstrate certain aspects and embodiments of the present invention. The invention may be better understood by reference to one or more of these drawings in combination with the detailed description of specific embodiments presented herein.

FIG. 13A shows an outline of a portion of one end of a bag with a step cut end, corresponding to a mirror image of the region marked as "A" in FIG. 11, detailing an alternate embodiment with angled portions between the back panel of the bag and the side wall, between the two sections of the side wall, and between the side wall and the front panel of the bag, and a tab feature at one end of the bag that extends into the seam. FIG. 13B shows an image of the top end of the bag depicted in FIG. 13A upon sealing the seam. FIG. 13C shows an image of the bottom end of the bag depicted in FIG. 13A upon sealing the seam.

FIG. 14A shows an outline of a portion of one end of a bag with a step cut end, corresponding to a mirror image of the region marked as "A" in FIG. 11, detailing an alternate embodiment with a combination of radial (circular) and angled portions between the back panel of the bag and the side wall, between the two sections of the side wall, and between the side wall and the front panel of the bag, and a tab feature at one end of the bag that extends into the seam. FIG. 14B shows an image of the top end of the bag depicted in FIG. 14A upon sealing the seam. FIG. 14C shows an image of the bottom end of the bag depicted in FIG. 14A upon sealing the seam.

DETAILED DESCRIPTION OF THE PREFERRED EMBODIMENT

Figure 1:
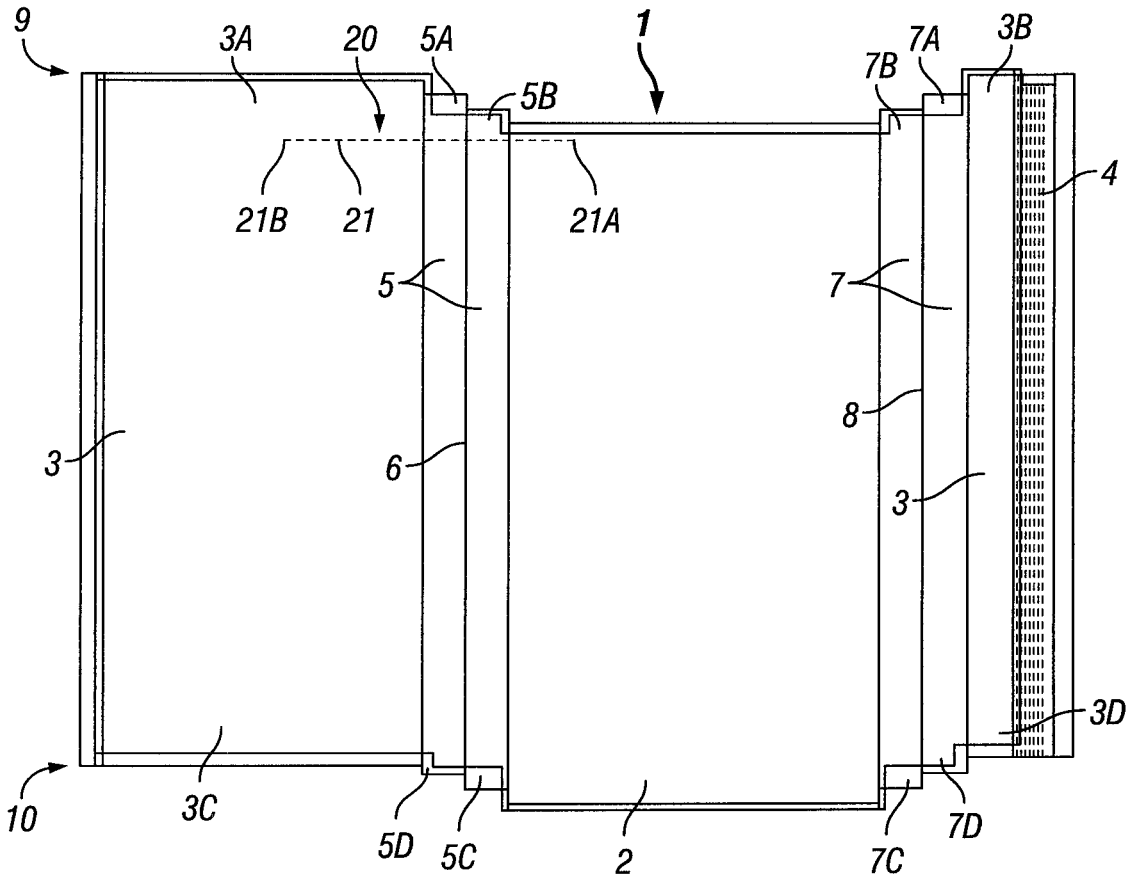
FIG. 1 shows an outline of a step cut bag with a weakened area near the top end of the bag comprising a line of perforations extending from the front panel of the bag across the first side panel of the bag to the back panel of the bag according to one embodiment of the present disclosure.

Referring to FIG. 1, a planar view of an embodiment of a substantially flat sheet of material from which a "step cut" bag 1 is to be formed is shown. Shown on the sheet are front wall 2, rear wall 3, seam 4, first side wall 5 having gusset portion 6, and second side wall 7 having gusset portion 8. As shown in FIG. 1, the bag 1 has a first or top end 9 and a second or bottom end 10, and thus each of the front wall 2, rear wall 3, first side wall 5 and second side wall 7 has a first or top end and a second or bottom end. It will be apparent, however, that the orientation of the bag ends 9 and 10 are unimportant and the "top" and "bottom" references are useful but may change depending upon the orientation from which one views the bag. Bag 1 is considered a "step cut" bag because the front wall 2, the first side wall 5 and the second side wall 7, and the rear wall 3 are cut so that the front wall 2, the first side wall 5 and the second side wall 7, and the rear wall 3 have different lengths on one end (or both ends) of the bag. As shown in FIG. 1, the first side wall 5 and the second side wall 7 are cut to different lengths on either side of the gusset portion 6 and 8, respectively. As shown in FIG. 1 the first end 9 of bag 1 has portions 3*a* and 3*b* of the rear wall 3 of the bag that extend further from the body of the bag 1 than do portions 5*a* and 7*a* of the first side wall 5 and second side wall 7, respectively, which in turn extend further from the body of the bag 1 than do portions 5*b* and 7*b* of the first side wall 5 and second side wall 7, respectively, which in turn extend further from the body of the bag 1 than does the top end of the front wall 2 of the bag 1. In addition, the bottom end of the front wall 2 at the second end 10 of bag 1 extends further from the body of the bag 1 than do portions 5*c* and 7*c* of the first side wall 5 and second side wall 7, respectively, which in turn extend further from the body of the bag 1 than do portions 5*d* and 7*d* of the first side wall 5 and second side wall 7, respectively, which in turn extend further from the body of the bag 1 than do portions 3*c* and 3*d* the bottom end of the rear wall 3 of the bag 1. Therefore, in the embodiment shown in FIG. 1 both of the ends of the bag 1 have a "step cut." Also shown is weakened portion 20, which in this embodiment is near the first end 9 of the bag 1 and comprises a plurality of perforations 21 extending from a first end 21*a* on the front wall 2 of the bag 1 across the first side wall 5 of the bag 1 to a second end 21*b* on the rear wall 3 of the bag 1. The weakened area is generally on or near the fold line (not shown) for closing or sealing the first end 9 of the bag 1. This weakened portion can be opened with less force than required to open or tear other portions of the bag 1.

Figure 2:
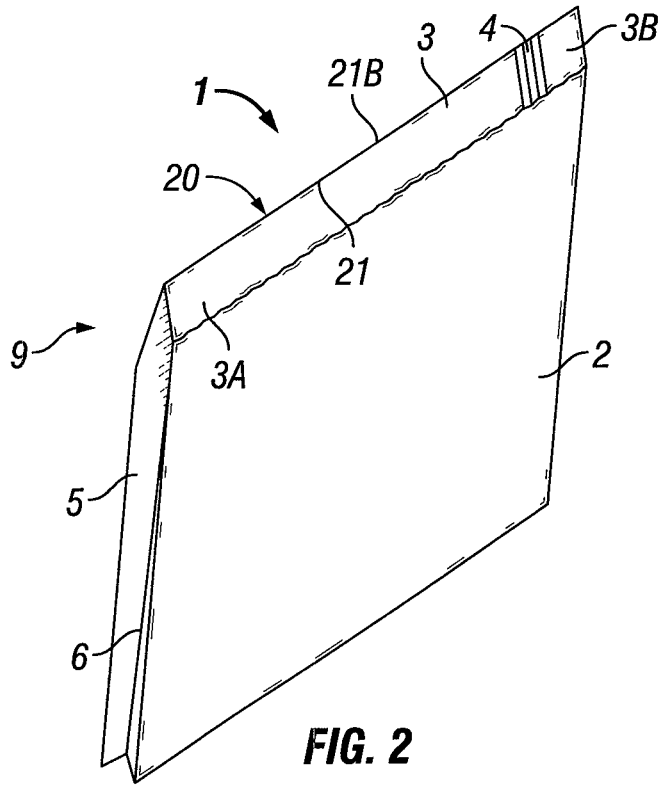
FIG. 2 shows the top portion of the bag of FIG. 1 after closing the top end of the bag.
Figure 3:
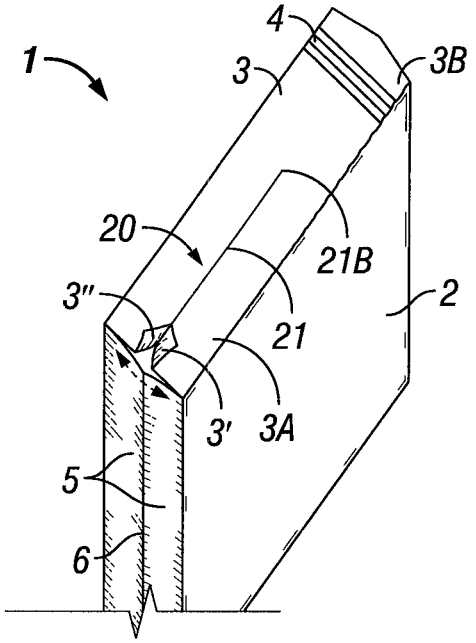
FIG. 3 shows the first step in opening the closed bag from FIG. 2.

Referring to FIG. 2, the upper portion of the bag 1 from FIG. 1 is shown after sealing the first end 9 of the bag 1. Visible in FIG. 2 is front wall 2, back wall 3 having portions 3*a* and 3*b*, seam 4, first side wall 5 having gusset portion 6, and weakened portion 20 comprising a plurality of perforations 21 terminating at second end 21*b*.

Figure 4:
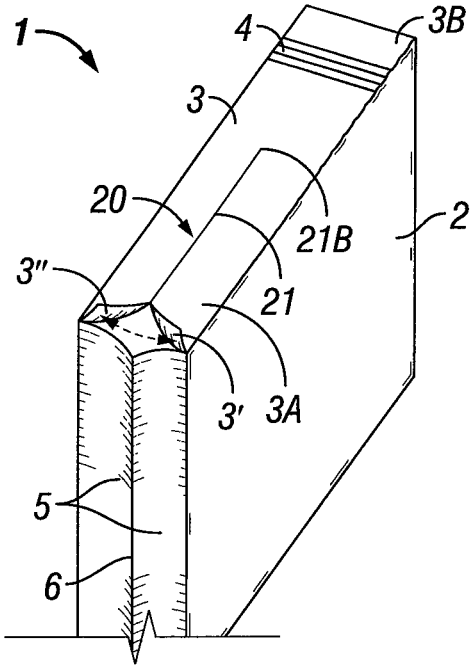
FIG. 4 shows the second step in opening the closed bag from FIG. 2.
Figure 5:
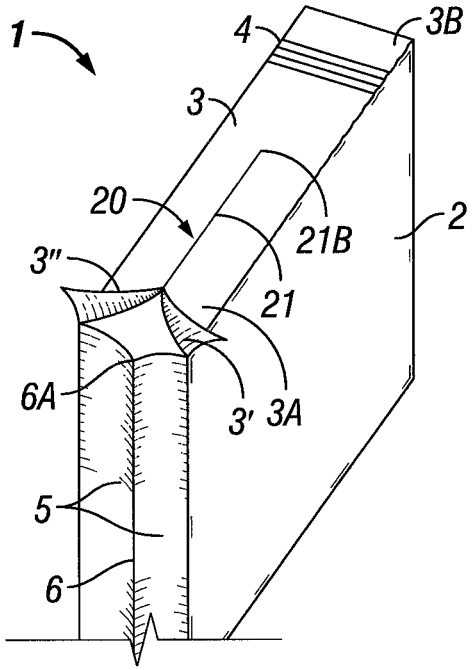
FIG. 5 shows the third step in opening the closed bag from FIG. 2.
Figure 6:
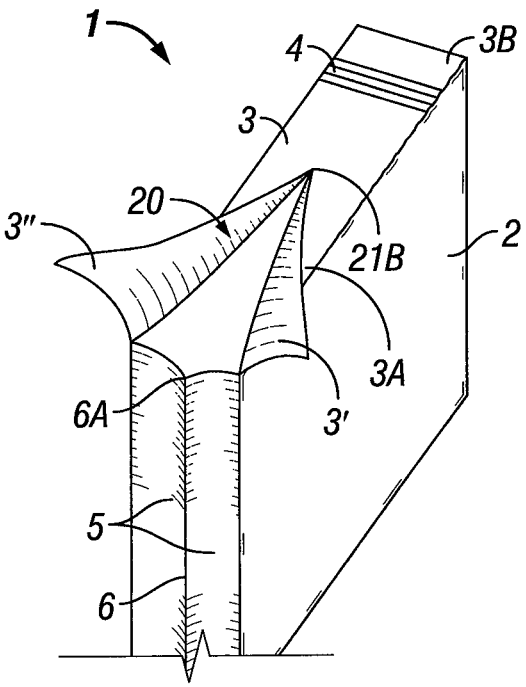
FIG. 6 shows the fourth step in opening the closed bag from FIG. 2.

Bag 1 can be opened as shown in FIG. 3 through FIG. 6. FIG. 3 once again shows the upper portion of the bag 1 from FIG. 2, and visible is front wall 2, back wall 3 having portions 3*a* and 3*b*, seam 4, first side wall 5 having gusset portion 6, and weakened portion 20 comprising a plurality of perforations 21 terminating at second end 21*b*. Bag 1 is opened by initially pulling on the portions 3' and 3" of the rear wall 3 on both sides of the plurality of perforations 21, which creates a tear in the weakened portion 20 of the bag 1 and begins separating the portions of the first side wall 5 that are separated by the gusset portion 6. In FIG. 4 the portions 3' and 3" of the rear wall 3 on both sides of the plurality of perforations 21 are further pulled apart, resulting in the expansion of the tear in the weakened portion 20 toward the second end 21*b* of the plurality of perforations 21. Additionally visible in FIG. 4 are front wall 2, back wall 3 having portions 3*a* and 3*b*, seam 4, and first side wall 5 having gusset portion 6. In FIG. 5 the portions 3' and 3" of the rear wall 3 on both sides of the plurality of perforations 21 are pulled completely apart, resulting in the expansion of the tear in the weakened portion 20 further toward the second end 21*b* of the plurality of perforations 21 and to the first end 21*a* of the plurality of perforations (not visible in FIG. 5). This results in uncovering the top end 6*a* of the gusset portion 6 of the first side wall 5, which can then be pulled open. Additionally visible in FIG. 5 are front wall 2, back wall 3 having portions 3*a* and 3*b*, and seam 4. In FIG. 6 the plurality of perforations 21 are pulled completely apart, resulting in the expansion of the tear in the weakened portion 20 to the second end 21*b* of the plurality of perforations 21. This results in a large opening in bag 1 that can be used to pour out the contents of the bag 1. Additionally visible in FIG. 6 are front wall 2, back wall 3 having portions 3*a*, 3*b*, 3' and 3", seam 4, first side wall 5 and gusset portion 6 having a top end 6*a*.

Figure 7:
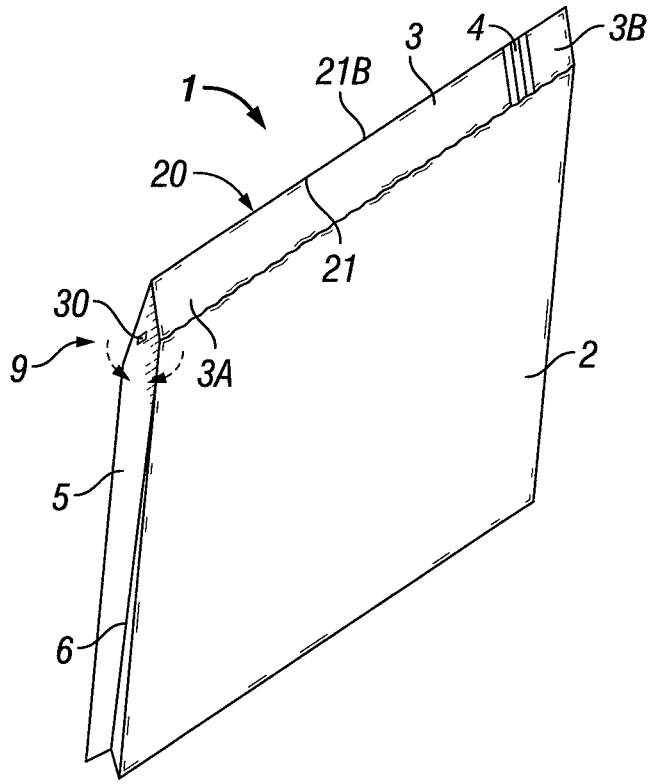
FIG. 7 shows the top portion of the bag of FIG. 1 after closing the top end of the bag and a location for optional application of adhesive to keep the top portion of the gusseted portion of the first side panel closed.

Referring to FIG. 7, the upper portion of the bag 1 from FIG. 1 is shown after sealing the first end 9 of the bag 1, with optional adhesive 30 located near the top end of the first side wall 5, which serves to keep the top end of the first side wall 5 closed (see arrows). Although not visible in FIG. 7, the optional adhesive can also be applied near the top end of the second side wall. Although shown as a spot in FIG. 7, the adhesive can be applied in any manner that results in the closure of the top end of the first side wall 5, for example as a strip that runs from the edge of the intersection of the first side wall 5 and the back wall 3 to the edge of the intersection of the first side wall 5 and the front wall 2. Also visible in FIG. 7 is front wall 2, back wall 3 having portions 3*a* and 3*b*, seam 4, first side wall 5 having gusset portion 6, and weakened portion 20 comprising a plurality of perforations 21 terminating at second end 21*b*.

Once the bag 1 is sealed at one end, it can be filled with the desired materials. For example, it has been found that a bag 1 with dimensions of 16.5 inches by 6.5 inches by 39.5 inches can durably hold up to about fifty five (55) pounds of material without showing undue stress, undue tearing, undue breakage, undue deformation, or leakage or the like. It is believed that any bulk material can be contained by bag 1, and in certain embodiments the contents can weigh up to 100 pounds or so without undue risk of tearing or damage to bag 1. Once the bag 1 is filled, the second end typically needs to be sealed. The second end of the bag 1 can be sealed in a similar manner as that described above. Alternatively, the bag 1 can have its second end sealed by conventional means such as sewing. Still another approach is to stitch the second end, and then seal the second end in a manner like that described above (not shown). Although not shown, those skilled in the art will understand and appreciate that a second end of bag 1 can be sealed using any conventional technique once bag 1 has been filled with the selected amount of the desired material.

Figure 8:
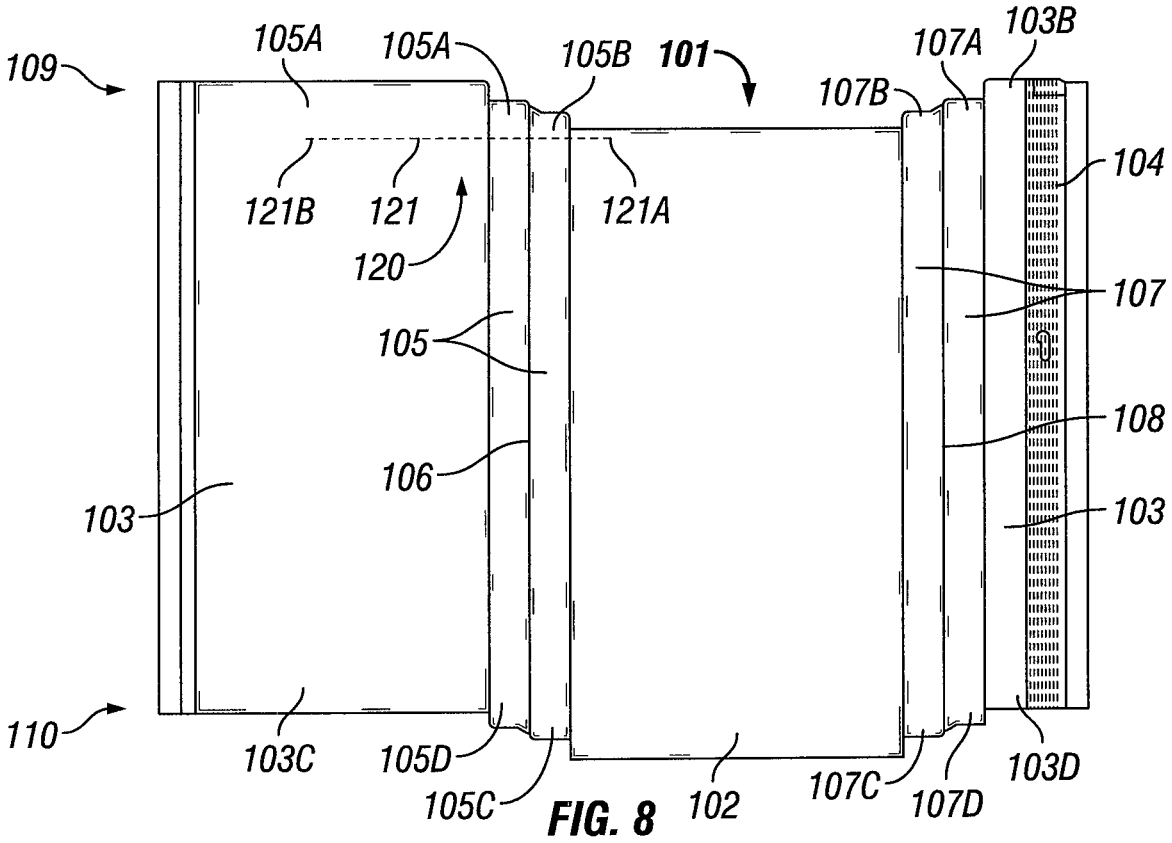
FIG. 8 shows an outline of a step cut bag with a weakened area near the top end of the bag comprising a line of perforations extending from the front panel of the bag across the first side panel of the bag to the back panel of the bag, and angled corners at the top and bottom of the portions of the first and second side panels on either side of the gusset fold, according to one embodiment of the present disclosure.

Referring to FIG. 8, a planar view of an embodiment of a substantially flat sheet of material from which a "step cut" bag 101 is to be formed is shown. Shown on the sheet are front wall 102, rear wall 103, seam 104, first side wall 105 having gusset portion 106, and second side wall 107 having gusset portion 108. As shown in FIG. 8, the bag 101 has a first or top end 109 and a second or bottom end 110, and thus each of the front wall 102, rear wall 103, first side wall 105 and second side wall 107 has a first or top end and a second or bottom end. It will be apparent, however, that the orientation of the bag ends 109 and 110 are unimportant and the "top" and "bottom" references are useful but may change depending upon the orientation from which one views the bag. Bag 101 is considered a "step cut" bag because the front wall 102, the first side wall 105 and the second side wall 107, and the rear wall 103 are cut so that the front wall 102, the first side wall 105 and the second side wall 107, and the rear wall 103 have different lengths on one end (or both ends) of the bag. As shown in FIG. 8, the first side wall 105 and the second side wall 107 are cut to different lengths on either side of the gusset portion 106 and 108, respectively. As shown in FIG. 8 the first end 109 of bag 101 has portions 103*a* and 103*b* of the rear wall 103 of the bag that extend further from the body of the bag 101 than do portions 105*a* and 107*a* of the first side wall 105 and second side wall 107, respectively, which in turn extend further from the body of the bag 101 than do portions 105*b* and 107*b* of the first side wall 105 and second side wall 107, respectively, which in turn extend further from the body of the bag 101 than does the top end of the front wall 102 of the bag 101. In addition, the bottom end of the front wall 102 at the second end 110 of bag 101 extends further from the body of the bag 101 than do portions 105*c* and 107*c* of the first side wall 105 and second side wall 107, respectively, which in turn extend further from the body of the bag 101 than do portions 105*d* and 107*d* of the first side wall 105 and second side wall 107, respectively, which in turn extend further from the body of the bag 101 than do portions 103*c* and 103*d* the bottom end of the rear wall 103 of the bag 101. Therefore, in the embodiment shown in FIG. 8 both of the ends of the bag 101 have a "step cut." In addition, the portions 105*a* and 105*b*, 107*a* and 107*b*, 105*c* and 105*d*, and 107*c* and 107*d* are not separated by a straight line, but rather an angled cut (see circles). Although in FIG. 8 this cut is shown as about 45°, the angle can vary in different embodiments (not shown). This angled cut serves to further prevent leakage of contents out of the bag, or infestation of organisms into the contents of the bag. Also shown is weakened portion 120, which in this embodiment is near the first end 109 of the bag 101 and comprises a plurality of perforations 121 extending from a first end 121*a* on the front wall 102 of the bag 101 across the first side wall 105 of the bag 101 to a second end 121*b* on the rear wall 103 of the bag 101. The weakened area is generally on or near the fold line (not shown) for closing or sealing the first end 109 of the bag 101. This weakened portion can be opened with less force than required to open or tear other portions of the bag 101.

Figure 9:
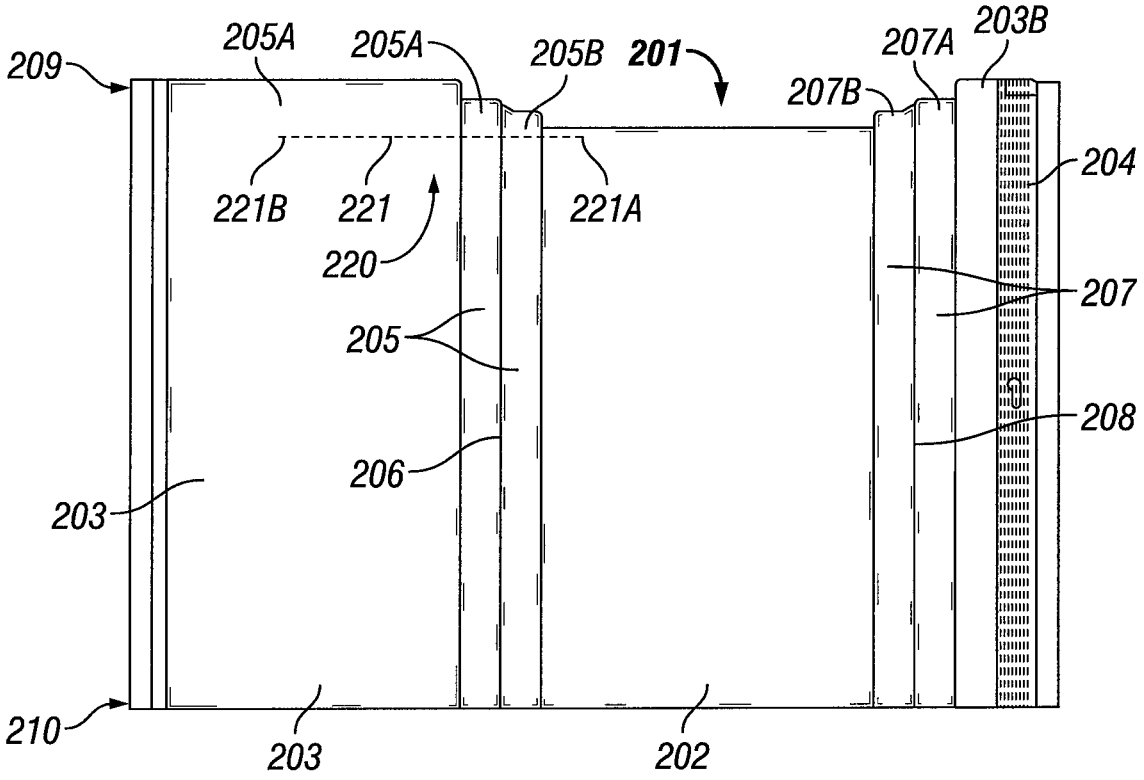
FIG. 9 shows an outline of a bag with a step cut top end and a flush cut bottom end, and a weakened area near the top end of the bag comprising a line of perforations extending from the front panel of the bag across the first side panel of the bag to the back panel of the bag according to one embodiment of the present disclosure.

Referring to FIG. 9, a planar view of an embodiment of a substantially flat sheet of material from which a bag 201 is to be formed is shown. Shown on the sheet are front wall 202, rear wall 203, seam 204, first side wall 205 having gusset portion 206, and second side wall 207 having gusset portion 208. As shown in FIG. 9, the bag 201 has a first or top end 209 and a second or bottom end 210, and thus each of the front wall 202, rear wall 203, first side wall 205 and second side wall 207 has a first or top end and a second or bottom end. It will be apparent, however, that the orientation of the bag ends 209 and 210 are unimportant and the "top" and "bottom" references are useful but may change depending upon the orientation from which one views the bag. The top end 209 of bag 201 is has a "step cut" because the front wall 202, the first side wall 205 and the second side wall 207, and the rear wall 203 are cut so that the front wall 202, the first side wall 205 and the second side wall 207, and the rear wall 203 have different lengths. As shown in FIG. 9, the first side wall 205 and the second side wall 207 are cut to different lengths on either side of the gusset portion 206 and 208, respectively. As shown in FIG. 9 the first end 209 of bag 201 has portions 203*a* and 203*b* of the rear wall 203 of the bag 201 that extend further from the body of the bag 201 than do portions 205*a* and 207*a* of the first side wall 205 and second side wall 207, respectively, which in turn extend further from the body of the bag 201 than do portions 205*b* and 207*b* of the first side wall 205 and second side wall 207, respectively, which in turn extend further from the body of the bag 201 than does the top end of the front wall 202 of the bag 201. In the embodiment shown in FIG. 9, the bottom end of the front wall 202, the first side wall 205, the second side wall 207, and the rear wall 203 at the second end 210 of bag 201 each extend the same distance from the body of the bag 201. Therefore, in the embodiment shown in FIG. 9 the bottom end 210 of the bag 201 has a "flush cut." Although not shown, in certain embodiments the top end of the bag can be flush cut, and the bottom end of the bag can be step cut. Also shown is weakened portion 220, which in this embodiment is near the first end 209 of the bag 201 and comprises a plurality of perforations 221 extending from a first end 221*a* on the front wall 202 of the bag 201 across the first side wall 205 of the bag 201 to a second end 221*b* on the rear wall 203 of the bag 201. The weakened area is generally on or near the fold line (not shown) for closing or sealing the first end 209 of the bag 201. This weakened portion can be opened with less force than required to open or tear other portions of the bag 201.

Figure 10:
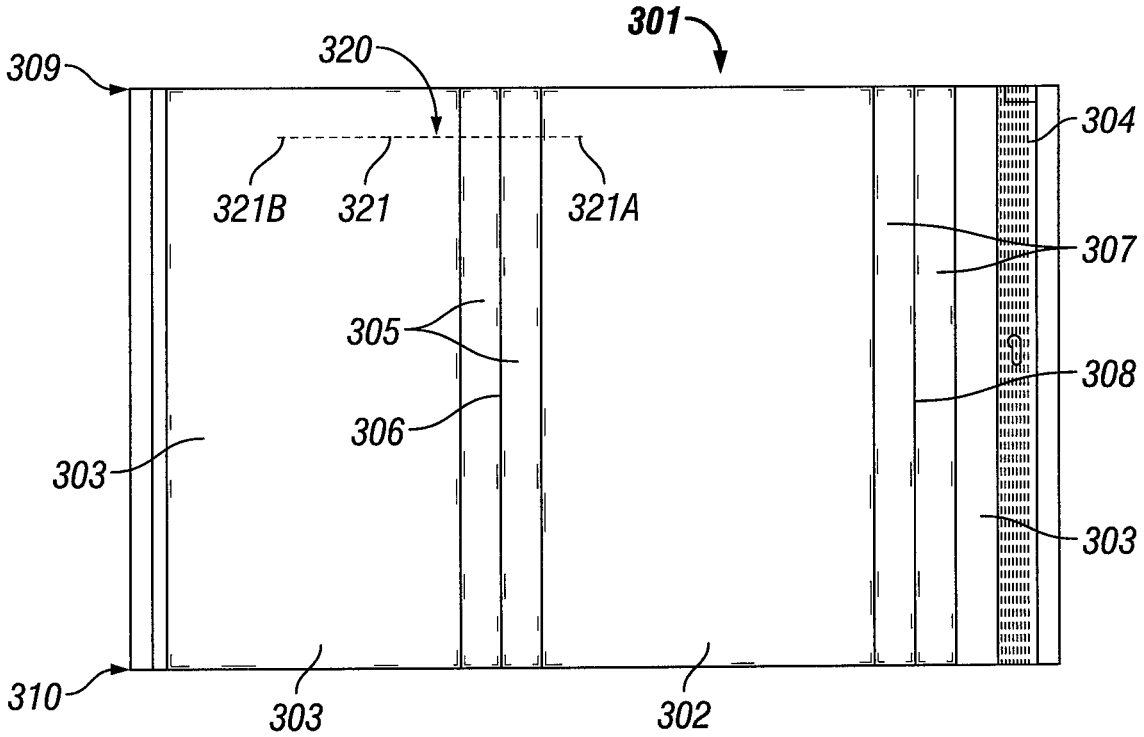
FIG. 10 shows an outline of a bag with a flush cut top end and a flush cut bottom end, and a weakened area near the top end of the bag comprising a line of perforations extending from the front panel of the bag across the first side panel of the bag to the back panel of the bag according to one embodiment of the present disclosure.

Referring to FIG. 10, a planar view of an embodiment of a substantially flat sheet of material from which a flush cut bag 301 is to be formed is shown. Shown on the sheet are front wall 302, rear wall 303, seam 304, first side wall 305 having gusset portion 306, and second side wall 307 having gusset portion 308. As shown in FIG. 10, the bag 301 has a first or top end 309 and a second or bottom end 310, and thus each of the front wall 302, rear wall 303, first side wall 305 and second side wall 307 has a first or top end and a second or bottom end. It will be apparent, however, that the orientation of the bag ends 309 and 310 are unimportant and the "top" and "bottom" references are useful but may change depending upon the orientation from which one views the bag. The top end 309 of bag 301 has a "flush cut" because the front wall 302, the first side wall 305 and the second side wall 307, and the rear wall 303 are cut to the same length. In the embodiment shown in FIG. 10, the bottom end of the front wall 302, the first side wall 305, the second side wall 307, and the rear wall 303 at the second end 310 of bag 301 each extend the same distance from the body of the bag 301. Therefore, in the embodiment shown in FIG. 10 the bottom end 310 of the bag 301 also has a "flush cut." Also shown is weakened portion 320, which in this embodiment is near the first end 309 of the bag 301 and comprises a plurality of perforations 321 extending from a first end 321*a* on the front wall 302 of the bag 301 across the first side wall 305 of the bag 301 to a second end 321*b* on the rear wall 303 of the bag 301. The weakened area is generally on or near the fold line (not shown) for closing or sealing the first end 309 of the bag 301. This weakened portion can be opened with less force than required to open or tear other portions of the bag 301.

Figure 11:
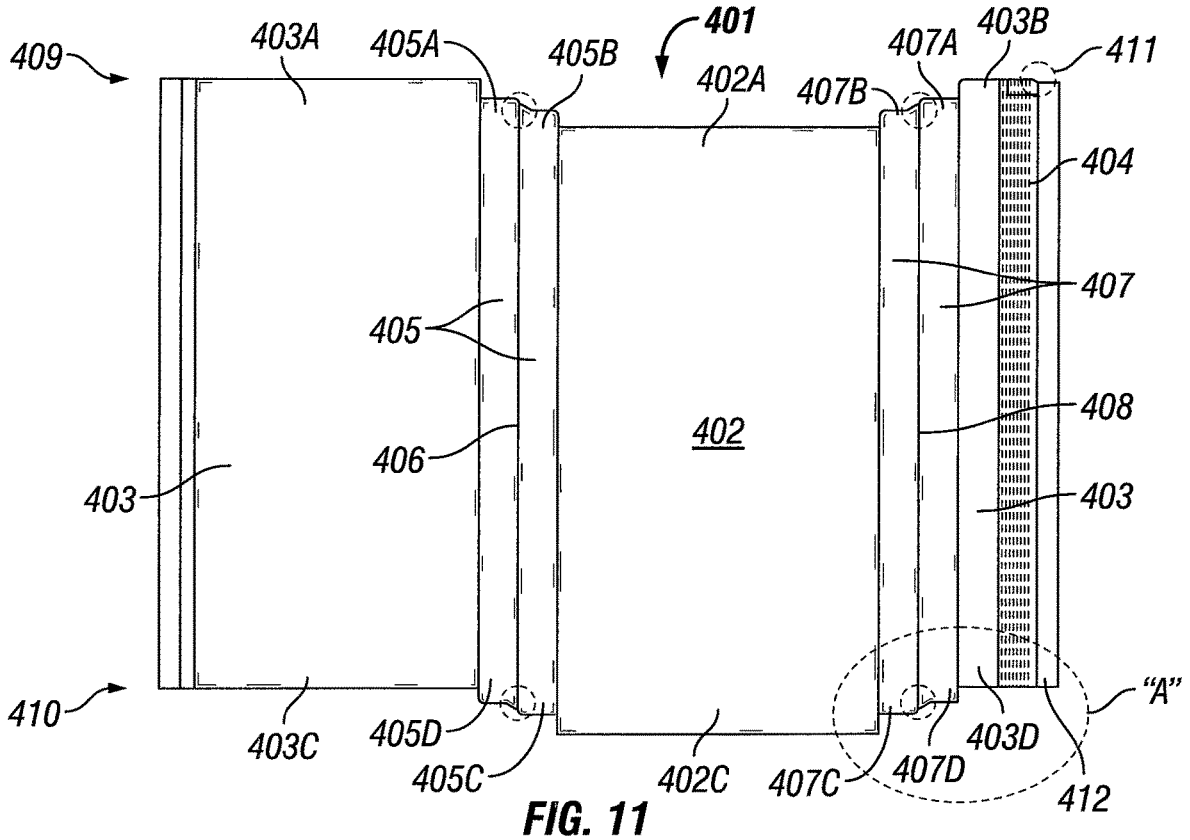
FIG. 11 shows an outline of a bag with a step cut top end and a step cut bottom end, with an angled portion between the two sections of the side wall at both ends of the bag, and a tab at one end of the bag and a cut-out feature at the other end of the bag that extend into the seam.

Referring to FIG. 11, a planar view of an embodiment of a substantially flat sheet of material from which a "step cut" bag 401 is to be formed is shown. Shown on the sheet are front wall 402, rear wall 403, seam 404, first side wall 405 having first gusset portion 406, and second side wall 407 having second gusset portion 408. As shown in FIG. 11, the bag 401 has a first or top end 409 and a second or bottom end 410, and thus each of the front wall 402, rear wall 403, first side wall 405 and second side wall 407 has a first or top end and a second or bottom end. It will be apparent, however, that the orientation of the bag ends 409 and 410 are unimportant and the "top" and "bottom" references are useful but may change depending upon the orientation from which one views the bag. Bag 401 is considered a "step cut" bag because the front wall 402, the first side wall 405 and the second side wall 407, and the rear wall 403 are cut so that the front wall 402, the first side wall 405 and the second side wall 407, and the rear wall 403 have different lengths on both ends of the bag. As shown in FIG. 11, the first side wall 405 and the second side wall 407 are cut to different lengths on either side of the gusset portion 406 and 408, respectively. As shown in FIG. 11 the first end 409 of bag 401 has portions 403*a* and 403*b* of the rear wall 403 of the bag that extend further from the body of the bag 401 than do portions 405*a* and 407*a* of the first side wall 405 and second side wall 407, respectively, which in turn extend further from the body of the bag 401 than do portions 405*b* and 407*b* of the first side wall 405 and second side wall 407, respectively, which in turn extend further from the body of the bag 401 than does the top end of the front wall 402 of the bag 401. In addition, the bottom end of the front wall 402 at the second end 410 of bag 401 extends further from the body of the bag 401 than do portions 405*c* and 407*c* of the first side wall 405 and second side wall 407, respectively, which in turn extend further from the body of the bag 401 than do portions 405*d* and 407*d* of the first side wall 405 and second side wall 407, respectively, which in turn extend further from the body of the bag 401 than do portions 403*c* and 403*d* the bottom end of the rear wall 403 of the bag 401. Therefore, in the embodiment shown in FIG. 11 both of the ends of the bag 401 have a "step cut." However, the skilled artisan will readily appreciate that in other embodiments (not shown), one or both ends of the bag can be a different type of step cut, or another type of cut altogether, for example a flush cut end as described herein. As shown in FIG. 11, the portions 403*a* and 405*a*, 405*b* and 402*a*, 402*a* and 407*b*, 407*a* and 403*b*, 403*c* and 405*d*, 405*c* and 402*c*, 402*c* and 407*c*, and 407*d* and 403*d*, respectively, are separated from one another not by straight lines and right angles but by curved portions or edges, which in FIG. 11 are shown as radial (circular) elements. Although one particular size and shape of radial portion is shown in FIG. 11, for the features between the foregoing portions, those skilled in the art will appreciate that in other embodiments (not shown), these radial portions can be as small or as large as desired. In addition, the portions 405*a* and 405*b*, 407*a* and 407*b*, 405*c* and 405*d*, and 407*c* and 407*d*, respectively, are not defined or separated by a radial portion or edge, but rather an angled portion or edge (see circles). Although in FIG. 11 this angled portion is shown as about 45° with respect to the top end of the front wall, the angle can vary in different embodiments (not shown). These radial and angled portions serve to further prevent breakage, leakage of contents out of the bag, or infestation of organisms into the contents of the bag, by providing extra material at one end of the bag that improves sealing. Further shown in FIG. 11 is cut-out 411 and corresponding tab 412 at opposing ends of the seam 404. Since the bag 401 is formed from a continuous sheet of material, the formation of the cut-out 411 (removal of material) at one end of the bag 401 results in a tab 412 (extra material) at the other end of the bag 401. The cut out 411 and tab 412 extend into the seam 404, and also serve to further prevent breakage, leakage of contents out of the bag, or infestation of organisms into the contents of the bag. This is because since extra material can be present between the seam 404 of the bag and the edge of the rear panel 403*b* of the bag that is not sealed, a hole can be present that can serve as an access point into or out of the sealed bag. But the presence of the cut-out 411 and the tab 412 ensures that the ends of any such hole will be sealed, preventing access into or out of the sealed bag. The cut-out 411 and tab 412 can be any depth/height desired, and can extend further into the seam as desired (not shown). Although in FIG. 11 the cut-out 411 and tab 412 are shown as extending from within the seam 404 to the edge of the rear panel 403*b* of the bag, in other embodiments (not shown) the cut-out and tab can extend from within the seam 404 only a portion of the distance to the edge of the rear panel 403*b* of the bag 401. Furthermore as shown, the tab and cut-out are illustrated as primarily rectangular in shape. It is understood that the shape is not limited to rectangles but can also be configured as an angular or rounded cut-out and matching tab as long as the configuration fits together to form a seal effective to prevent leakage or infestation. Additionally, in other embodiments (not shown), the bag can comprise an easy open or easy access feature, such as the weakened portion near the top of the bag as shown herein above (for example in FIG. 8), or the easy open features detailed in United States Patent Application Publication Number US 2013/0206631 and United States Patent Application Publication Number US 2013/0209002, each of which is incorporated by reference herein in its entirety.

Figure 12:
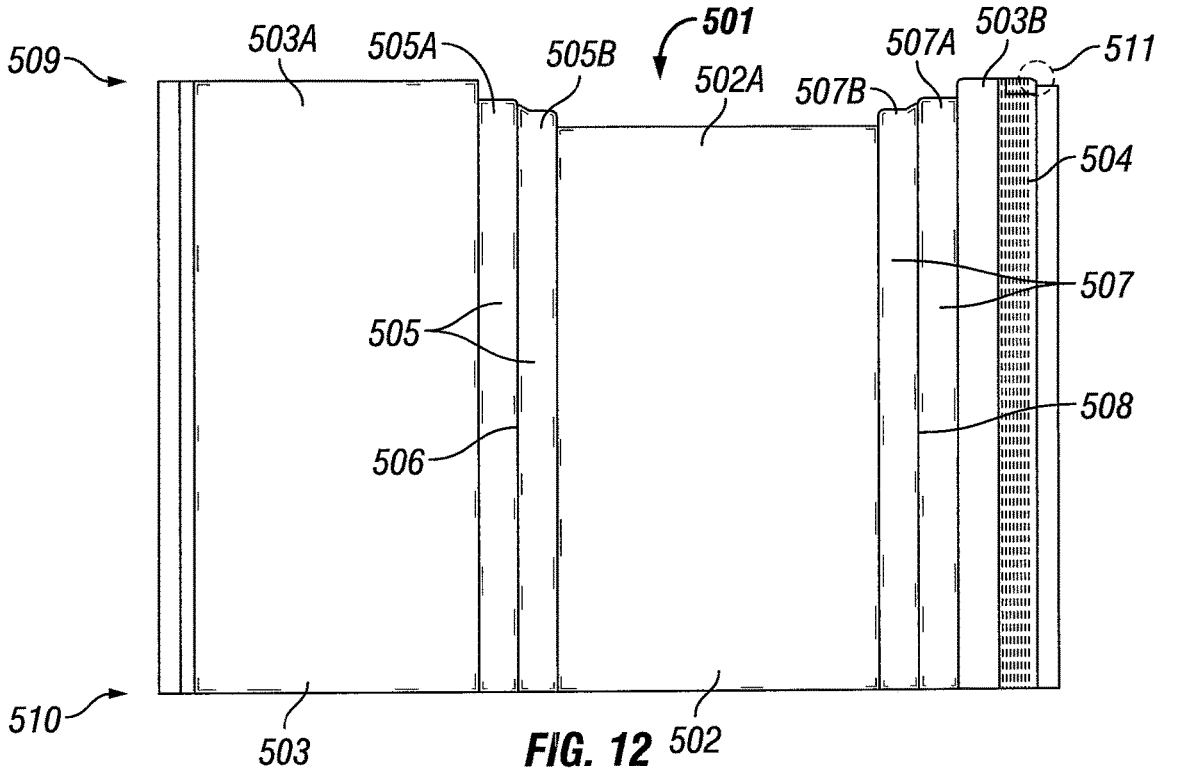
FIG. 12 shows an outline of the top portion of a bag with a step cut top end, with radial (circular) portions between the back panel of the bag and the side wall, between the two sections of the side wall, and between the side wall and the front panel of the bag at the top end of the bag, and a cut-out feature at the top end of the bag that extends into the seam.

Referring to FIG. 12, a planar view of the top portion of an embodiment of a substantially flat sheet of material from which a bag 501 is to be formed is shown. Shown on the sheet are front wall 502, rear wall 503, seam 504, first side wall 505 having first gusset portion 506, and second side wall 507 having second gusset portion 508. As shown in FIG. 12, the bag 501 has a first or top end 509 and a second or bottom end 510 (not visible in FIG. 12), and thus each of the front wall 502, rear wall 503, first side wall 505 and second side wall 507 has a first or top end and a second or bottom end. It will be apparent, however, that the orientation of the bag ends 509 and 510 are unimportant and the "top" and "bottom" references are useful but may change depending upon the orientation from which one views the bag. The top end 509 of bag 501 has a "step cut" because the front wall 502, the first side wall 505 and the second side wall 507, and the rear wall 503 are cut so that the front wall 502, the first side wall 505 and the second side wall 507, and the rear wall 503 have different lengths. As shown in FIG. 12, the first side wall 505 and the second side wall 507 are cut to different lengths on either side of the gusset portion 506 and 508, respectively. As shown in FIG. 12 the first end 509 of bag 501 has portions 503*a* and 503*b* of the rear wall 503 of the bag 501 that extend further from the body of the bag 501 than do portions 505*a* and 507*a* of the first side wall 505 and second side wall 507, respectively, which in turn extend further from the body of the bag 501 than do portions 505*b* and 507*b* of the first side wall 505 and second side wall 507, respectively, which in turn extend further from the body of the bag 501 than does the top end of the front wall 502 of the bag 501. As shown in FIG. 12, the portions 503*a* and 505*a*, 505*a* and 505*b*, 505*b* and 502*a*, 502*a* and 507*b*, 507*b* and 507*a*, and 507*a* and 503*b*, respectively, are separated not by straight lines and right angles but by curved portions or edges, such as radial (circular) portions as shown. Although one particular size and shape of the curved portions is shown in FIG. 12, those skilled in the art will understand that in other embodiments (not shown) these curved edges can be of different shapes (e.g., elliptical, or different segments of a curve, etc.), and can be as small or as large as desired. These curved portions serve to further prevent breakage or leakage of contents out of the bag, or infestation of organisms into the contents of the bag. Further shown in FIG. 12 is cut-out 511 at one end of the seam 504 (corresponding tab 512 at the other end of the seam 504 is not shown in FIG. 12). Since the bag 501 is formed from a continuous sheet of material, formation of the cut-out 511 (removal of material) at one end of the bag 501 results in a tab (extra material; not shown in FIG. 12) at the other end of the bag 501. The cut out 511 and tab (not shown in FIG. 12) extend into the seam 504, and also serve to further prevent breakage, leakage of contents out of the bag, or infestation of organisms into the contents of the bag. The cut-out 511 and tab (not shown) can be any depth/height desired, and can extend further into the seam as desired (not shown). Although in FIG. 12 the cut-out 511 (and corresponding tab, not shown) is shown as extending from within the seam 504 to the edge of the rear panel 503*b* of the bag, in other embodiments (not shown) the cut-out (and tab) can extend from within the seam 504 only a portion of the distance to the edge of the rear panel 503*b* of the bag. Additionally, in other embodiments (not shown), the bag can comprise an easy open or easy access feature, such as the weakened portion near the top of the bag as shown herein above (for example in FIG. 8), or the easy open features detailed in United States Patent Application Publication Number US 2013/0206631 and United States Patent Application Publication Number US 2013/0209002, each of which is incorporated by reference herein in its entirety.

Referring to FIG. 13A, shown is an outline of a portion of one end of a bag 600 with a step cut end, generally corresponding to a mirror image of the region marked as "A" in FIG. 11, detailing an alternate embodiment with angled portions between the front panel 602 of the bag and the first section of the side wall 607', between the first section of the side wall 607' and the second section of the side wall 607", and between the second section of the side wall 607" and the back panel 603 of the bag, respectively, and a feature 613 at one end of the bag that extends into the seam. Since the bag 600 is formed from a continuous sheet of material, the feature 613 forms a cut-out 611 (removal of material; see FIG. 13B) at one end of the bag and a tab 612 (extra material; see FIG. 13C) at the other end of the bag. FIG. 13B shows an image of one end of the bag depicted in FIG. 13A upon sealing the seam 604, showing cut-out 611. FIG. 13C shows an image of the other end of the bag depicted in FIG. 13A upon sealing the seam 604, showing the tab 612.

Referring to FIG. 14A, shown is an outline of a portion of one end of a bag 700 with a step cut end, generally corresponding to a mirror image of the region marked as "A" in FIG. 11, detailing an alternate embodiment with a combination of radial and angled cuts between the front panel 702 of the bag and the first section of the side wall 707', between the first section of the side wall 707' and the second section of the side wall 707", and between the second section of the side wall 707" and the back panel 703 of the bag, respectively, and a feature 713 at one end of the bag 700 that extends into the seam. Since the bag 700 is formed from a continuous sheet of material, the feature 713 forms a cut-out 711 (removal of material; see FIG. 14B) at one end of the bag 700 and a tab 712 (extra material; see FIG. 14C) at the other end of the bag 700. FIG. 14B shows an image of one end of the bag depicted in FIG. 14A upon sealing the seam 704, showing cut-out 711. FIG. 14C shows an image of the other end of the bag depicted in FIG. 14A upon sealing the seam 704, showing the tab 712.

Those skilled in the art will understand and appreciate that the bag according to the invention may vary in size, dimensions, and shape without departing from the scope of the invention, and that the foregoing description of the preferred embodiments is not intended to limit the scope of the invention as defined by the claims. For example, those skilled in the art will understand and appreciate that the bags shown and described in the various embodiments can have sealed and sewn ends in a tubular bag with side gussets as shown, or a block bottom and top, or a combination thereof, although not shown. Those skilled in the art will also appreciate that a weakened portion or area can be provided in a number of ways that may vary from those expressly described and shown, such as by stressing portions of the bag wall with or without deforming or perforating same, as well as varying the size, number, depth, and/or pattern of perforations and/or deformations in a bag wall. Similarly, those skilled in the art will understand that the bags shown and described in the various embodiments may be provided with a re-usable opening (not shown). Such features are conventional with prior art bags. Similarly, those skilled in the art will appreciate that terms such as "front" and "rear," and "top" and "bottom," are useful in describing a bag, but essentially depend on a bag's orientation when such terms are used, and are therefore not limiting as to a bag's orientation.

The invention claimed is:

1. A bag comprising:

a front wall comprising a top end and a bottom end, a back wall comprising a top end and a bottom end, and a first side wall, and a second side wall disposed on opposite sides of the front and back walls and connecting the front wall to the back wall, forming a bag with a top end and a bottom end, each of the first side wall and the second side wall comprising a gusset with a central fold line extending from the bottom end to the top end of the respective side walls and dividing each of said first side wall and said second side wall into a front side wall and a back side wall;

wherein each of the front wall, back wall, first side wall and second side wall comprise (i) a first layer comprising a woven polymer and (ii) a second layer laminated to the first layer, said second layer comprising a polymer film; and wherein at least one of said top end or bottom end of the bag comprises a step cut configuration comprising a plurality of step cuts, each perpendicular to the top end or bottom end, respectively, and further having a separation between each adjacent step cut, and further wherein the separations of the back wall from the first side wall and the second side wall, the front wall from the first side wall and the second side wall, and the first and second front side walls from the first and second back side walls at the gusset fold lines have the following sequence:

a radial cut for the separation between the adjacent step cuts that form an outside corner of the back wall, an angled cut for the separation between the adjacent step cuts that form an inside corner of the back wall from the first back side wall, a radial cut for the separation between the adjacent step cuts that form an outside corner of the first back side wall, an angled cut for the separation between the adjacent step cuts that form an inside corner of the first back side wall from the first front side wall, a radial cut for the separation between the adjacent step cuts that form an outside corner of the first front side wall, an angled cut for the separation between the adjacent perpendicular step cuts that form an inside corner of the first front side wall from the front wall, wherein each angled cut is between about 15° and about 75° with respect to the top end of the front wall.

2. The bag of claim 1, wherein one or more of the separations between the adjacent step cut defined by an angle cut is between 30° and 60° with respect to the top end of the front wall.

3. The bag of claim 1, wherein one or more of the separations between the adjacent step cuts defined by an angle cut is at 45° with respect to the top end of the front wall.

4. The bag of claim 1, wherein one or more of the separations between the adjacent step cuts defined by a radial cut is an elliptical, parabolic, or hyperbolic curve.

5. The bag of claim 1, wherein the bag comprises an easy open or easy access feature.

6. The bag of claim 5, wherein the easy open or easy access feature comprises a weakened area.

7. The bag of claim 6, wherein the weakened area comprises a line of perforations proximal the top end of the front wall, and extending from the front wall through a first side wall and into the back wall.

8. The bag of claim 1, wherein said first layer comprises polypropylene, high density polyethylene, low density polyethylene, polyester, or any combination thereof.

9. The bag of claim 1, wherein said second layer comprises polypropylene, polyethylene, polyethylene terephthalate, polyamide, or any combination thereof or paper.

10. The bag of claim 1, wherein the second layer comprises oriented polypropylene, biaxially-oriented polypropylene, oriented polyethylene, biaxially-oriented polyethylene, oriented polyethylene terephthalate, biaxially-oriented polyethylene terephthalate, oriented polyamide, biaxially-oriented polyamide, coated paper or any combination thereof.

11. The bag of claim 1, wherein said first layer and said second layer comprise polyethylene.

12. The bag of claim 1, wherein said first layer and said second layer comprise polypropylene.

13. A bag comprising:

a front wall comprising a top end and a bottom end, a back wall comprising a top end and a bottom end, and a first side wall, and a second side wall disposed on opposite sides of the front and back walls and connecting the front wall to the back wall, forming a bag with a top end and a bottom end, each of the first side wall and the second side wall comprising a gusset with a central fold line extending from the bottom end to the top end of the respective side walls and dividing each of said first side wall and said second side wall into a front side wall and a back side wall;

wherein each of the front wall, back wall, first side wall and second side wall comprise (i) a first layer comprising a woven polymer and (ii) a second layer laminated to the first layer, said second layer comprising a polymer film; and wherein at least one of said top end or bottom end of the bag comprises a step cut configuration comprising a plurality of step cuts, each perpendicular to the top end or bottom end, respectively, and further having separations between adjacent step cuts of the back wall from the first side wall and the second side wall, the front wall from the first side wall and the second side wall, and the first and second front side walls from the first and second back side walls at the gusset fold lines, and further wherein the separations comprise alternating radial and angled cuts for the separations between adjacent step cuts of the front wall, the first side wall, and the back wall and the front wall, the second side wall, and the back wall, wherein each angled cut is between about 15° and about 75° with respect to the top end of the front wall.

14. The bag of claim 13, wherein one or more of the separations between the adjacent step cut defined by an angle cut is between 30° and 60° with respect to the top end of the front wall.

15. The bag of claim 13, wherein one or more of the separations between the adjacent step cut defined by an angle cut is at 45° with respect to the top end of the front wall.

16. The bag of claim 13, wherein one or more of the separations between the adjacent step cuts defined by a radial cut is an elliptical, parabolic, or hyperbolic curve.

17. The bag of claim 13, wherein the bag comprises an easy open or easy access feature.

18. The bag of claim 17, wherein the easy open or easy access feature comprises a weakened area.

19. The bag of claim 18, wherein the weakened area comprises a line of perforations proximal the top end of the front wall, and extending from the front wall through a first side wall and into the back wall.

20. The bag of claim 13, wherein said first layer comprises polypropylene, high density polyethylene, low density polyethylene, polyester, or any combination thereof.

21. The bag of claim 13, wherein said second layer comprises polypropylene, polyethylene, polyethylene terephthalate, polyamide, or any combination thereof or paper.

22. The bag of claim 13, wherein the second layer comprises oriented polypropylene, biaxially-oriented polypropylene, oriented polyethylene, biaxially-oriented polyethylene, oriented polyethylene terephthalate, biaxially-oriented polyethylene terephthalate, oriented polyamide, biaxially-oriented polyamide, coated paper or any combination thereof.

23. The bag of claim 13, wherein each of the front wall, back wall, first side wall and second side wall further comprise a third layer, wherein said third layer comprises polypropylene, high density polyethylene, low density polyethylene, polyester, or any combination thereof and laminating said first layer to said second layer.

24. The bag of claim 23, wherein said third layer comprises a polymeric film.

25. The bag of claim 23, wherein said third layer comprises polypropylene, polyethylene, polyethylene terephthalate, polyamide, or any combination thereof.

26. The bag of claim 23, wherein said first layer, said second layer and said third layer comprise polyethylene.

27. The bag of claim 23, wherein said first layer, said second layer and said third layer comprise polypropylene.

* * * * *